US008147081B2

(12) United States Patent
Mrakovich et al.

(10) Patent No.: US 8,147,081 B2
(45) Date of Patent: Apr. 3, 2012

(54) DIRECTIONAL LINEAR LIGHT SOURCE

(75) Inventors: Matthew S. Mrakovich, Streetsboro, OH (US); Mark J. Mayer, Sagamore Hills, OH (US)

(73) Assignee: Lumination LLC, Valley View, OH (US)

( * ) Notice: Subject to any disclaimer, the term of this patent is extended or adjusted under 35 U.S.C. 154(b) by 721 days.

(21) Appl. No.: 11/964,135

(22) Filed: Dec. 26, 2007

(65) Prior Publication Data

US 2009/0168395 A1 Jul. 2, 2009

(51) Int. Cl.
*F21V 9/16* (2006.01)
*F21S 4/00* (2006.01)

(52) U.S. Cl. ..... 362/84; 362/217.06; 362/249.02; 362/299; 362/300; 362/311.02

(58) Field of Classification Search ..... 362/84
See application file for complete search history.

(56) References Cited

U.S. PATENT DOCUMENTS 5,887,968 A 3/1999 Logan
0,006,039 A1 1/2002 Ueda et al.
6,504,301 B1 * 1/2003 Lowery ..... 313/512
6,953,261 B1 10/2005 Jiao et al.
0,259,424 A1 11/2005 Zampini, II et al.
6,997,575 B2 2/2006 Sommers
7,040,782 B2 5/2006 Mayer
7,048,385 B2 5/2006 Beeson et al.
7,052,152 B2 5/2006 Harbers et al.
7,070,300 B2 7/2006 Harbers et al.
7,224,000 B2 5/2007 Aanegola et al.
7,264,366 B2 * 9/2007 Hulse ..... 362/84
7,482,567 B2 * 1/2009 Hoelen et al. ..... 250/205
7,663,152 B2 * 2/2010 Bierhuizen et al. ..... 257/98
2007/0274096 A1 * 11/2007 Chew et al. ..... 362/609

* cited by examiner

*Primary Examiner* — Diane Lee
*Assistant Examiner* — Sean Gramling
(74) *Attorney, Agent, or Firm* — Fay Sharpe LLP

(57) ABSTRACT

An illumination apparatus includes a linear array of light emitting diode (LED) chips disposed on a support. A linear reflector assembly has a light coupling reflector portion and a one dimensional light collimation or focusing portion. The linear reflector assembly is secured to the support parallel with the linear array of LED chips. An encapsulant is disposed in the light coupling reflector portion of the linear reflector assembly and pots the LED chips. An elongate phosphor element is disposed over the encapsulant such that the light coupling reflector portion and the encapsulant enhance light coupling between the LED chips and the elongate phosphor element, and the one-dimensional light collimation or focusing portion one-dimensionally collimates or focuses light emitted by the combination of the LED chips and the elongate phosphor element.

11 Claims, 3 Drawing Sheets

DIRECTIONAL LINEAR LIGHT SOURCE

BACKGROUND

The following relates to the lighting arts. It finds application for example in general illumination, accent lighting, architectural lighting, and so forth.

The combination of light emitting diode (LED) devices with wavelength-converting phosphor has well understood advantages. LED devices generally emit light over a relatively narrow spectral range, which is not suitable for typical illumination applications. By coupling LED devices with wavelength converting phosphor, light of broader spectrum can be generated, including various spectrums corresponding to white light.

However, it has also been recognized that a difficulty with this combination is that the phosphor can degrade over time. Phosphor degradation has been observed in various LED/phosphor combinations, and is particularly problematic in white devices that combine an LED emitting in the blue, violet, or ultraviolet range with a white phosphor composition. Phosphor degradation typically results from heating. A known solution is to place the phosphor remotely from the LED die. An example of such a device is set forth in U.S. Pat. No. 7,224,000.

Remotely positioned phosphor address the problem of heat-induced phosphor degradation. Additionally, for most applications the arrangement has the further advantage of spreading out the illumination over the area of the remote phosphor, so as to provide wide angle illumination.

For some applications, however, narrow angle illumination is desired. Such applications include, for example, accent lighting intended to "wash" a wall with light, lighting intended to track a walkway, formation of a free-standing planar "wall" of light, or so forth. Existing LED/phosphor combinations are generally not well-suited for such applications. For example, providing a linear array of phosphor coated LEDs or of LED/remote phosphor combinational elements such as those disclosed in U.S. Pat. No. 7,224,000 would provide a linear light source, but one which emits illumination over a relatively broad angular range.

BRIEF SUMMARY

In accordance with certain illustrative embodiments shown and described as examples herein, an illumination apparatus is disclosed, comprising: a linear array of light emitting diode (LED) chips; an elongate phosphor element parallel with and spaced apart from the linear array of LED chips, the linear array of LED chips being optically coupled with the elongate phosphor element to optically energize the elongate phosphor element to emit wavelength-converted light; and a linear focusing or collimating reflector parallel with the elongate phosphor element and arranged to one-dimensionally focus or collimate the wavelength-converted light.

In accordance with certain illustrative embodiments shown and described as examples herein, an illumination apparatus is disclosed, comprising: an elongate phosphor element; a linear array of light emitting diode (LED) chips spaced apart from and arranged to optically energize the elongate phosphor element, the elongate phosphor element and the linear array of LED chips defining a common plane; and a linear focusing or collimating reflector arranged to one-dimensionally focus or collimate wavelength converted light generated by the elongate phosphor element responsive to energizing by the linear array of LED chips.

In accordance with certain illustrative embodiments shown and described as examples herein, an illumination apparatus is disclosed, comprising: a linear array of light emitting diode (LED) chips disposed on a support; a linear reflector assembly having a light coupling reflector portion and a one-dimensional light collimation or focusing portion, the linear reflector assembly being secured to the support parallel with the linear array of LED chips; an encapsulant disposed in the light coupling reflector portion of the linear reflector assembly and potting the LED chips; and an elongate phosphor element disposed over the encapsulant such that the light coupling reflector portion and the encapsulant enhance light coupling between the LED chips and the elongate phosphor element and the one-dimensional light collimation or focusing portion one-dimensionally collimates or focuses light emitted by the combination of the LED chips and the elongate phosphor element.

Numerous advantages and benefits of the present invention will become apparent to those of ordinary skill in the art upon reading and understanding the present specification.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

DETAILED DESCRIPTION OF PREFERRED EMBODIMENTS

Figure 1:
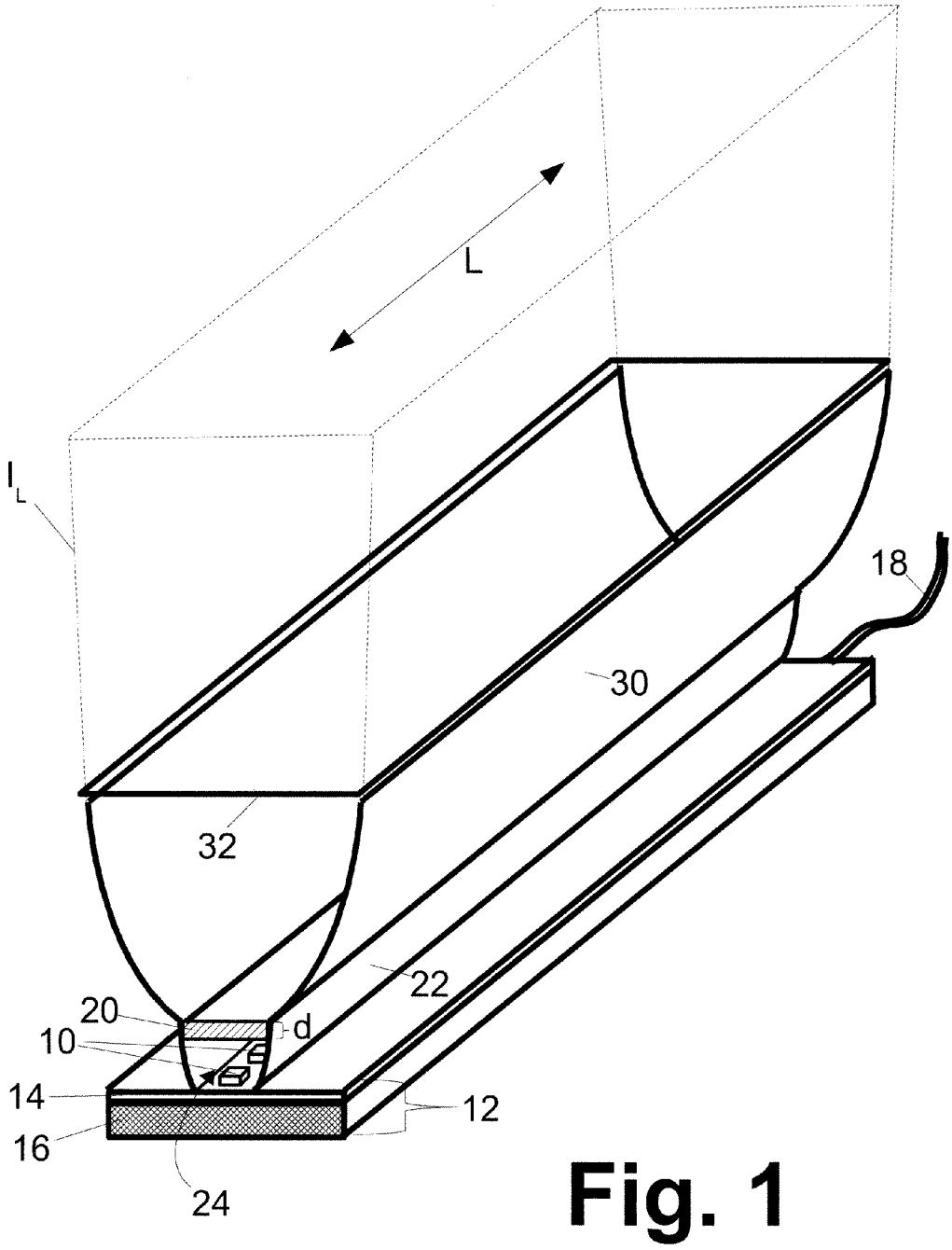
FIG. 1 diagrammatically shows a perspective view of an illustrative linear light source, with a portion cut away to provide a cross-section revealing internal components of the linear light source.
Figure 2:
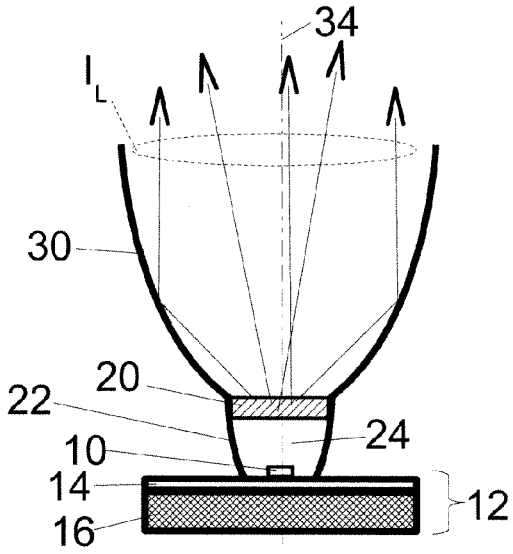
FIG. 2 diagrammatically shows a side-sectional view of the illustrative linear light source of FIG. 1.

With reference to FIGS. 1 and 2, a linear light source includes a linear array of light emitting diode (LED) chips 10 disposed on a support 12. The linear array of LED chips 10 is parallel with a linear direction or direction of elongation denoted by the double-headed arrow L in FIG. 1. The LED chips 10 may be group III-nitride LED chips, group III-phosphide LED chips, group III-arsenide LED chips, or so forth, and may be configured as vertical chips, lateral chips, surface mount chips, flip-chip devices, or so forth, and may be either bare chips or packaged chips disposed, for example, in a lead frame or on a submount. In the illustrated embodiment, the support circuit board 14 disposed on a metal plate 16 or other thermally conductive heat sink. The circuit board 14 includes suitable printed circuitry or other electrical pathways (not shown) for interconnecting the LED chips 10 with an electrical power supply (not shown) via a power cord 18 or other power input pathway. Although not shown, it is contemplated for the circuit board 14 to further include selected electronic components for performing power conversion (e.g., a.c.-d.c. conversion, voltage level conversion, etc.), power conditioning, power distribution amongst the LED chips 10, or so forth.

The LED chips 10 are arranged in a linear array and are optically coupled with a parallel elongate phosphor element 20 spaced apart from the LED chips 10. The elongate phosphor element 20 may, for example, be a deposition or coating of an epoxy or other matrix or host material containing one or more phosphor components, or may be an elongate plate of glass, plastic, or another transparent material having one or more phosphor components coated thereon or embedded therein, or so forth. The elongate phosphor element 20 may be continuous along the direction of elongation, or in some contemplated embodiments may be in the form of a discontinuous chain or linear array of component phosphor elements arranged parallel with the direction of elongation L. The optical coupling is provided or enhanced by a linear coupling element, such as an illustrated linear coupling reflector 22 having reflective sides extending between the LED chips 10 and the phosphor element 20 to redirect side-emitted light toward the phosphor element 20. Additionally or alternatively, the linear coupling element can include a parallel linear light-transmissive encapsulant that encapsulates the LED chips 10 and bridges the gap or spacing between the linear array of LED chips 10 and the parallel elongate remote phosphor element 20. In the illustrated embodiment, for example, a linear light-transmissive encapsulant 24 comprises a material such as silicone, epoxy, or so forth filling the linear coupling reflector 22, encapsulating the LED chips 10, and providing a support surface for the linear phosphor strip or other elongate phosphor element 20. In some manufacturing embodiments, the LED chips 10 and the linear coupling reflector 22 are both mounted on the support 12, the mounted linear coupling reflector 22 is filled with the encapsulant 24 so as to pot or encapsulate the LED chips 10, and the elongate phosphor element 20 is deposited by spray coating, painting, vacuum deposition, or another process onto the upper surface of the encapsulant 24. Optionally, the surface of the encapsulant distal from the LED chips 10 is leveled, mechanically shaped, or otherwise prepared prior to deposition or other application of the elongate phosphor element 20.

As used herein, the term "light" is to be broadly construed as encompassing radiation having a wavelength (or, equivalently, a frequency) located anywhere in the visible spectrum or anywhere in the ultraviolet or infrared spectral regions. The elongate phosphor element 20 includes a material that converts light generated by the LED chips 10 into light of a desired spectrum. As some illustrative examples, the LED chips 10 can be configured to emit in the violet or ultraviolet light (for example, by including a group III-nitride active region having a suitable bandgap or energy levels for facilitating electron-hole recombination generating violet or ultraviolet light) and the elongate phosphor element 20 can include a combination of fluorescent or phosphorescent components (for example, red, blue, and green or yellow fluorescent or phosphorescent components) that convert the violet or ultraviolet light into a spectrum of light that appears visually as white light. As another illustrative example, the LED chips 10 can be configured to emit blue light and the elongate phosphor element 20 configured to emit yellow or yellowish light that is combinable in suitable proportion with the blue light to appear visually as white light. As yet another illustrative example, the LED chips 10 can be configured to emit violet or ultraviolet light and the elongate phosphor element 20 configured to convert the violet or ultraviolet light to light of a selected color such as red light.

The elongate phosphor element 20 has a thickness d selected to provide the desired amount of light conversion while allowing the converted light, and optionally some of the direct light from the LED chips 10, to be emitted from the side of the phosphor 20 remote from the LED chips 10. For example, in a combination of violet or ultraviolet LED chips and a white-emitting phosphor, the thickness d is suitably selected to be sufficiently thick to convert substantially all of the violet or ultraviolet light to white light, while being sufficiently thin to mitigate loss of white light by reabsorption, scattering, or other loss processes that may occur in the phosphor 20. For complete conversion, the elongate phosphor element 20 preferably includes phosphor conversion material continuously along the length of the phosphor element 20, without any gaps through which direct light from the LED chips 10 could escape. On the other hand, in embodiments in which blue emission from the LED chips 10 is combined with yellow emission from the phosphor 20 to generate light appearing as white, the thickness d is suitably selected to be sufficiently thick to convert a selected fraction of the blue light to yellow light such that the combination of blue and yellow light output from the side of the phosphor 20 distal from the LED chips 10 is of a proportion suitably appearing as white light. Alternatively or additionally, the elongate phosphor element 20 in these embodiments may have gaps in the continuity of the phosphor conversion material along the direction of elongation, through which gaps a selected portion of direct light from the LED chips 10 can escape without conversion. Although the elongate phosphor element 20 is shown in FIGS. 1 and 2 as having flat top and bottom surfaces, it is also contemplated for the elongate phosphor element 20 to have curved surfaces; for example, the phosphor 20 may be curved in the plane transverse to the linear direction L such that all points on the surface have about the same shortest distance to the linear array of LED chips 10. Although not illustrated, it is also contemplated (for embodiments in which the direct emission of the LED chips 10 does not contribute to the output) to include a wavelength selective reflective layer on the surface of the phosphor 20 distal from the LED chips 10 that reflects the direct LED chip emission while passing the wavelength-converted phosphor emission.

The illustrated linear coupling reflector 22 defines a linear source region and has reflective sides extending from the linear source region and defining a linear light aperture oriented parallel with the linear source region. The linear array of LED chips 10 is disposed parallel with and in or proximate to the linear source region and distal from the linear light aperture, while the elongate phosphor element 20 disposed at or proximate to the linear light aperture and distal from the linear source region. The linear coupling reflector 22 optically couples the LED chips 10 and the linear phosphor 20. Optionally, the parallel linear encapsulant 24 also contributes to the optical coupling.

The light output from the elongate phosphor element 20 on the side distal from the LED chips 10 is of the desired spectrum and is linear parallel with the linear direction L. However, the light is not collimated or focused transverse to the linear direction L.

A second reflector 30 is disposed to receive and collimate output light $I_L$ from the linear light aperture of the linear coupling reflector 22, that is, from the side of the phosphor element 20 distal from the LED chips 10. The illustrative second reflector 30 of FIGS. 1 and 2 is a linear collimating reflector arranged parallel with the linear phosphor element 20 and arranged to one-dimensionally collimate the wavelength-converted light forming the output light $I_L$ and, optionally, to one-dimensionally collimate any direct radiation that passes through the phosphor element 20 to contribute to the output light $I_L$. The term "one-dimensional collimation" as used herein denotes collimation in the plane transverse to the linear direction L without collimation parallel to the linear direction L. As a result, the linear light source generates the output light $I_L$ collimated in the plane transverse to the linear direction L so as to form a generally planar beam of light $I_L$ (where the linear direction L lies parallel with the generally planar beam of light $I_L$). The generally planar beam of light $I_L$ is substantially collimated (but optionally slightly diverging) in the direction traverse to the linear direction L. FIG. 2 illustrates the beam of light $I_L$ using some illustrative ray traces to show how the collimating second reflector 30 provides the one-dimensional collimation.

Figure 3:
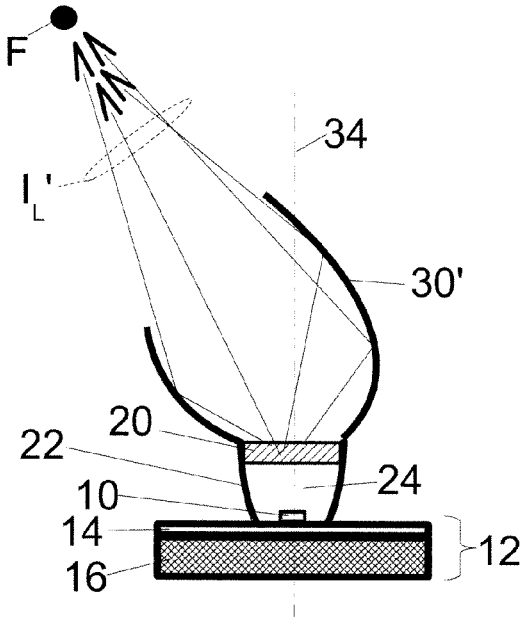
FIG. 3 diagrammatically shows a side-sectional view of the illustrative light source of FIG. 1, but with a modified second reflector providing focusing.

With reference to FIG. 3, in a variant embodiment a second reflector 30' is a focusing reflector. The focusing reflector 30' is disposed to receive and focus output light $I_L'$ from the linear light aperture of the linear coupling reflector 22, that is, from the side of the phosphor element 20 distal from the LED chips 10. The illustrative second reflector 30' of FIG. 3 is a linear focusing reflector arranged parallel with the linear phosphor element 20 and arranged to one-dimensionally focus the wavelength-converted light forming the output light $I_L'$ and, optionally, to one-dimensionally focus any direct radiation that passes through the phosphor element 20 to contribute to the output light $I_L'$. The term "one-dimensional focusing" as used herein denotes focusing in the plane transverse to the linear direction L without focusing parallel to the linear direction L. As a result, the linear light source generates the output light $I_L'$ that is focused in the plane transverse to the linear direction L to a linear focus line F. In FIG. 3, the linear focus line F appears as a point since the linear focus line F is being viewed along the linear direction L in FIG. 3; it is to be appreciated that the linear focus line F is parallel with the linear direction L. The one-dimensional focusing is in the plane transverse to the linear direction L. FIG. 3 illustrates the beam of light $I_L'$ using some illustrative ray traces to show how the focusing second reflector 30' provides one-dimensional collimation.

The elongate phosphor element 20 is secured together with the focusing or collimating reflector 30, 30' at a focus or light input aperture of the linear focusing or collimating reflector 30, 30'. The focusing or collimating reflector 30, 30' has a linear focus arranged parallel with the linear direction L, and serves to efficiently collimate or focus the wavelength converted light emanating from the elongate phosphor element 20 disposed at the focus or light input aperture. Moreover, if direct light from the LED chips 10 contributes to the light output, the linear focusing or collimating reflector 30, 30' serves to collimate or focus that light as well. Optionally, the elongate phosphor element 20 may contain light scattering particles to scatter the portion of direct light from the LED chips 10 that is not wavelength converted by the phosphor 20. By such scattering, the direct light is also emitted as if generated in or at the phosphor element 20, and so is efficiently collimated or focused.

A light transmissive cover plate 32 is optionally disposed over the light emitting aperture of the collimating second reflector 30, as shown in FIG. 1. Although not shown, a light transmissive cover plate can also optionally be disposed over the light emitting aperture of the focusing second reflector 30' of FIG. 3.

The illustrative collimating second reflector 30 is a symmetric collimating reflector that produces the generally planar collimated beam of light $I_L$ arranged symmetrically respective to the linear light source. In such a symmetric arrangement, the light $I_L$ is collimated in a common plane 34 that also contains the linear array of LED chips 10 and the elongate phosphor element 20. The illustrative focusing second reflector 30' is an asymmetric focusing reflector that focuses the light to the focal line F disposed asymmetrically respective to the linear light source. In this embodiment, the light $I_L'$ is focused at the focus line F which is outside of the common plane 34 containing both the linear array of LED chips 10 and the elongate phosphor element 20. These are illustrative examples, and it is to be understood that the second reflector can also be configured as an asymmetric collimating reflector, or as a symmetric focusing reflector. Moreover, the coupling reflector and the collimating or focusing reflector can employ reflective surfaces, total internal reflection (TIR), holographic or diffractive reflection, or some combination of such reflective mechanisms.

Figure 4:
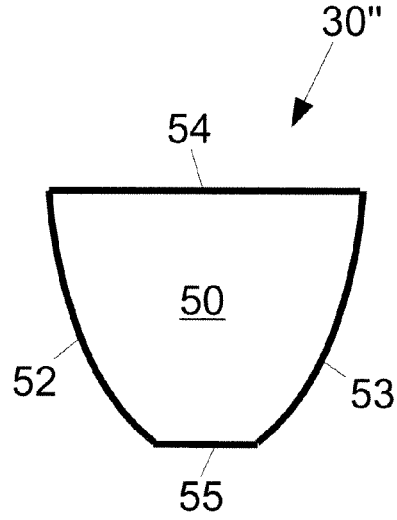
FIG. 4 diagrammatically shows a side-sectional view of an alternative collimating reflector operating on the principle of total internal reflection (TIR), which is suitably used in place of the collimating reflector of FIG. 2.

With reference to FIG. 4, for example, the collimating reflector 30 is optionally replaced by an analogous TIR collimating reflector 30" which is made of a solid light-transmissive material 50, such as optical glass or a transparent plastic material, having a relatively high refractive index such that light $I_L$ travelling inside the solid TIR reflector 30" is reflected at surfaces 52, 53 by total internal reflection to produce the same reflective effect as is provided by the collimating reflector 30. To obtain total internal reflection, the condition $n \cdot \sin(\theta) > 90°$ should be satisfied, where n is the refractive index of the material 50, θ is the angle of incidence of light impinging on the interface 52 (or on the interface 53) from within the material 50 referenced from the surface normal, and the ambient just outside of the TIR surface 52, 53 is assumed to have refractive index of unity (as is the case for an air or vacuum ambient, for example). In some embodiments, it is contemplated to provide scalloping or other surface relief microstructure at the TIR surfaces 52, 53 to provide angles suitable for producing TIR. The light exits surface 54, which is somewhat analogous to the light-transmissive cover plate 32 of FIG. 1, except that the surface 54 is defined by a surface of the solid TIR reflector 30". In some embodiments, the light-exit surface 54 is contemplated to be non-planar. The light is suitably input to the TIR collimating reflector 30" through input surface 55, which surface 55 in some embodiments supports the elongate phosphor element 20 as a phosphor coating applied to the surface 55. Although not illustrated, it is to be appreciated that the focusing reflector 30' of FIG. 3, or the linear coupling reflector 22, can also be replaced by a TIR reflector. For example, referring back to FIG. 2 the linear light-transmissive encapsulant 24 may be provided without the linear coupling reflector 22, with the encapsulant material having a sufficiently high refractive index to provide reflection by TIR without reliance upon the separate reflector 22. If both reflectors 22, 30 are replaced by TIR equivalents, then the elongate phosphor element 20 is suitably disposed between the two TIR reflectors. In some such embodiments, the elongate phosphor element may be a phosphor-containing adhesive or glue that bonds the TIR equivalent to the reflector 22 with the input surface 55 of the illustrated TIR collimating reflector 30".

The disclosed linear light sources advantageously provide one-dimensionally collimated or focused light. The elongate phosphor element 20 is advantageously arranged spaced apart or remote from the LED chips 10 to reduce likelihood of phosphor degradation over time, yet the phosphor element 20 remains closely optically coupled with the LED chips 10 through the coupling elements 22, 24. Moreover, the optional light transmissive encapsulant 24 may provide waveguiding of light emitted by the LED chips 10 along the linear direction L, so as to reduce or eliminate non-uniformity of the output light $I_L$, $I_L'$ along the linear direction L by providing excitation of portions of the elongate phosphor element 20 located between neighboring LED chips 10. Thus, the light transmissive encapsulant 24 can serve as a linear waveguiding element disposed in a gap between the elongate phosphor element 20 and the spaced apart linear array of LED chips 10, the linear waveguiding element spreading light from the LED chips 10 and coupling said light substantially uniformly along the elongate phosphor element 20.

The disclosed linear light sources have further advantages in terms of manufacturability and robustness.

Figure 5:
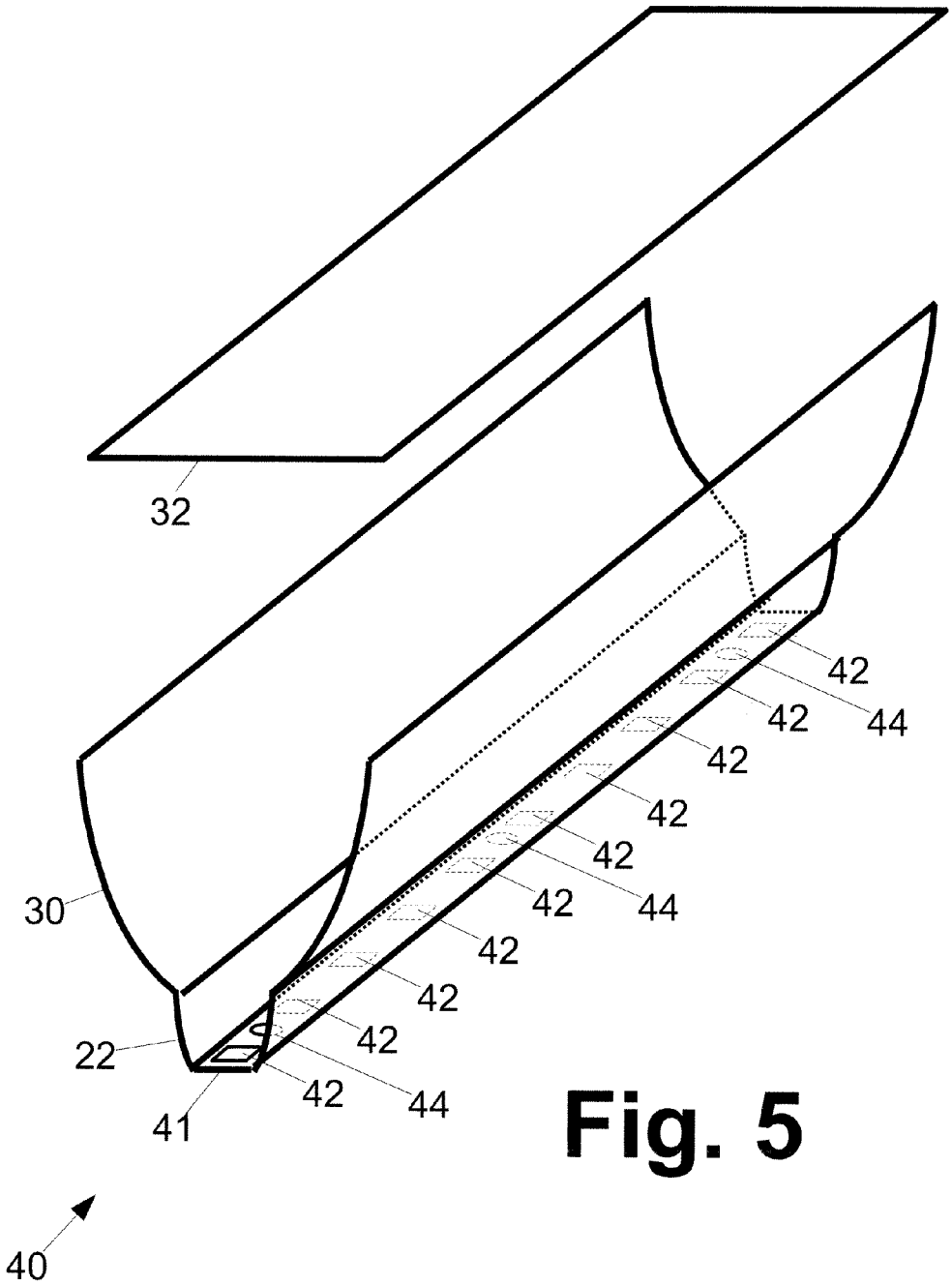
FIG. 5 diagrammatically shows a perspective view of a single piece manufacturing embodiment of the first and second reflectors of the illustrative linear light source of FIG. 1, with hidden lines shown in phantom.

With reference to FIG. 5, in a suitable manufacturing process, the first and second reflectors 22, 30 are manufactured as a single piece 40 that is suitably an injection molded piece, a formed sheet metal piece, or so forth. In the case of a non-reflective material such as plastic, a reflective coating can be applied to the inner surfaces of the piece 40 to provide high reflectivity. In FIG. 5 the single piece 40 is shown in perspective view with hidden lines shown in phantom. The single piece 40 includes a connecting portion 41 spanning the linear source region of the light coupling reflector 22. The connecting portion 41 includes a first set of openings 42 (rectangular in the illustrative example) that receive the LED chips 10 mounted on the support 12, and a second set of openings 44 (circular or elliptical in the illustrative example) that serve as mounting holes for securing the single piece 40 to the support 12. The assembly entails mounting the LED chips 10 and the single piece 40 to the support 12, then potting the LED chips 10 by filling the light coupling reflector 22 with the encapsulant 24, optional smoothing or shaping of the encapsulant surface, followed by coating the exposed and optionally smoothed or shaped surface of the encapsulant 24 with a phosphor-containing coating to form the elongate phosphor element 20. The optional light transmissive cover plate 32, is suitably secured to the single piece 40 after the phosphor element 20 has been added.

With brief reference back to FIG. 4, as another manufacturing example the TIR collimating reflector 30" or other elongate TIR reflector can be manufactured by an extrusion process or other suitable process for manufacturing an elongate solid optical element having a defined cross-section. As noted previously, the phosphor element 20 can be coated or otherwise disposed onto the input surface 55 of the TIR collimating reflector 30", or can be coated onto the encapsulant 24 as previously described, or otherwise formed.

Robustness of the resulting linear light source is enhanced by the optional potting of the sensitive LED chips 10, by the limited number of component pieces, and by the optional sealing of the phosphor element 20 by the combination of the single piece 40 and the optional light transmissive cover plate 32. (Although not shown, complete sealing of the volume containing the elongate phosphor element 20 can be achieved in the embodiment of FIG. 5 by adding end plates at the ends of the single piece 40, such end plates being either integrally formed with the single piece 40 or secured to the ends similarly to the cover plate 32).

The manufacturing process described with reference to FIG. 5 is an illustrative example. Other manufacturing processes can be used. In some such embodiments, for example, the reflectors 22, 30 are not integrally formed. In some embodiments the reflectors 22, 30 are contemplated to be integrally formed but to omit the connecting portion 41, so that the integral reflectors 22, 30 are formed as separate pieces each defining a side.

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

The appended claims follow:

1. An illumination apparatus comprising:

an elongate phosphor element;

a linear array of light emitting diode (LED) chips spaced apart from and arranged to optically energize the elongate phosphor element, the elongate phosphor element and the linear array of LED chips defining a common plane that intersects both the elongate phosphor element and the linear array of LED chips; and an asymmetric focusing reflector arranged to one-dimensionally focus wavelength converted light generated by the elongate phosphor element responsive to energizing by the linear array of LED chips wherein the asymmetric focusing reflector linearly focuses the wavelength converted light outside of the common plane intersecting both the elongate phosphor element and the linear array of LED chips.

2. The illumination apparatus as set forth in claim 1, further comprising:

a linear waveguiding element disposed in a gap between the elongate phosphor element and the spaced apart linear array of LED chips, the linear waveguiding element spreading light from the LED chips and coupling said light substantially uniformly along the elongate phosphor element.

3. The illumination apparatus as set forth in claim 1, wherein the asymmetric focusing reflector comprises a TIR reflector.

4. The illumination apparatus as set forth in claim 1, wherein the elongate phosphor element is generally planar with said plane arranged generally transverse to the common plane intersecting the elongate phosphor element and the linear array of LED chips.

5. The illumination apparatus as set forth in claim 1, wherein the linear array of LED chips is disposed outside of the asymmetric focusing reflector.

6. The illumination apparatus as set forth in claim 5, wherein the elongate phosphor element is secured together with the asymmetric focusing reflector at a focus or light input aperture of the asymmetric focusing reflector.

7. The illumination apparatus as set forth in claim 1, wherein the asymmetric focusing reflector is a TIR reflector, and the elongate phosphor element includes a coating disposed on a light input surface of the asymmetric focusing TIR reflector.

8. The illumination apparatus as set forth in claim 1, wherein a portion of light from the LED chips does not energize the elongate phosphor element, and the elongate phosphor element comprises:

light scattering particles that scatter the portion of light from the LED chips not energizing the elongate phosphor element, the asymmetric focusing reflector one-dimensionally focusing the scattered portion of light from the LED chips that does not energize the elongate phosphor element.

9. An illumination apparatus comprising:

a linear array of light emitting diode (LED) chips disposed on a support;

a linear reflector assembly having a light coupling reflector portion and an asymmetric one-dimensional focusing portion wherein the light coupling reflector portion and the asymmetric one-dimensional focusing portion of the linear reflector assembly are integrally formed as a single piece, the linear reflector assembly being secured to the support parallel with the linear array of LED chips;

an encapsulant disposed in the light coupling reflector portion of the linear reflector assembly and potting the LED chips; and an elongate phosphor element disposed over the encapsulant such that the light coupling reflector portion and the encapsulant enhance light coupling between the LED chips and the elongate phosphor element and the asymmetric one-dimensional focusing portion linearly focuses light emitted by the combination of the LED chips and the elongate phosphor element outside of a common plane intersecting both the elongate phosphor element and the linear array of LED chips.

10. The illumination apparatus as set forth in claim 9, further comprising:

a light-transmissive cover plate disposed over an open end of the asymmetric or one-dimensional focusing portion of the linear reflector assembly, the light-transmissive cover plate cooperating with the linear reflector assembly to seal the elongate phosphor element.

11. The illumination apparatus as set forth in claim 9, wherein the linear array of LED chips emit violet or ultraviolet light and the elongate element phosphor converts the violet or ultraviolet light to an emission appearing as white light.

* * * * *